US010345040B2

(12) United States Patent
Bahner et al.

(10) Patent No.: US 10,345,040 B2
(45) Date of Patent: Jul. 9, 2019

(54) METHOD FOR CONTROLLING A COUPLED HEAT EXCHANGER SYSTEM AND HEAT EXCHANGER SYSTEM

(71) Applicant: LINDE AKTIENGESELLSCHAFT, Munich (DE)

(72) Inventors: Valdo Bahner, München (DE); Thomas Hecht, Puchheim (DE)

(73) Assignee: LINDE AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 15/513,167

(22) PCT Filed: Oct. 8, 2015

(86) PCT No.: PCT/EP2015/001980
§ 371 (c)(1),
(2) Date: Mar. 22, 2017

(87) PCT Pub. No.: WO2016/055162
PCT Pub. Date: Apr. 14, 2016

(65) Prior Publication Data

US 2017/0314852 A1 Nov. 2, 2017

(30) Foreign Application Priority Data

Oct. 9, 2014 (EP) ..... 14003476

(51) Int. Cl.
*F25J 3/04* (2006.01)
*F28F 27/02* (2006.01)
(Continued)

(52) U.S. Cl.
CPC ..... *F25J 3/0486* (2013.01); *F25J 3/042* (2013.01); *F25J 3/0409* (2013.01);
(Continued)

(58) Field of Classification Search
CPC ..... F28F 27/00; F28F 27/02; F25J 3/04193; F25J 3/04218; F25J 3/04303;
(Continued)

(56) References Cited

U.S. PATENT DOCUMENTS 3,167,113 A * 1/1965 Kleiss ..... F28F 27/00 165/293
4,381,814 A 5/1983 Funk
2015/0369548 A1 12/2015 Fersti et al.

FOREIGN PATENT DOCUMENTS

DE 4204172 A1 8/1993
DE 102009/042994 A1 3/2011
(Continued)

*Primary Examiner* — Brian M King
(74) *Attorney, Agent, or Firm* — Millen White Zelano & Branigan, PC

(57) ABSTRACT

A method for controlling a coupled heat exchanger system having a first heat exchanger block and a second heat exchanger block. A first fluid stream is divided into a first partial current and a second partial current both flowing through the heat exchanger system. A second fluid stream flows through the first heat exchanger block counter to the first partial current. A third fluid stream flows through the second heat exchanger block counter to the second partial current. An intermediate temperature is measured on one of the heat exchanger blocks. The amount of the first partial current and the second partial current is controlled based on the current value of the intermediate temperature. This control reduces the strain on the heat exchangers by changing loads while keeping fluctuations of the intermediate temperature low.

15 Claims, 2 Drawing Sheets

Figure 1:
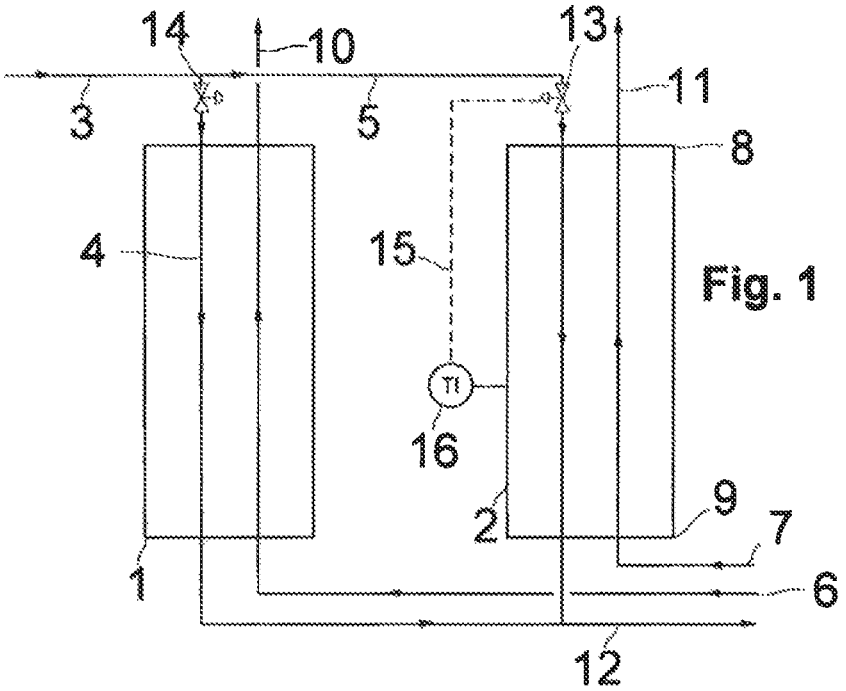

(51) Int. Cl.

| | |
|---|---|
| ***F28F 9/26*** | (2006.01) |
| ***F28D 9/00*** | (2006.01) |
| *F28D 21/00* | (2006.01) |

(52) U.S. Cl.
CPC ..... *F25J 3/04218* (2013.01); *F25J 3/04393* (2013.01); *F25J 3/04787* (2013.01); *F28D 9/0093* (2013.01); *F28F 9/26* (2013.01); *F28F 27/02* (2013.01); *F25J 3/04224* (2013.01); *F25J 3/04412* (2013.01); *F28D 2021/0033* (2013.01)

(58) Field of Classification Search
CPC .... F25J 3/04309; F25J 3/04503; F25J 3/0486; F25J 3/04787
See application file for complete search history.

(56) References Cited

FOREIGN PATENT DOCUMENTS

| | | | |
|---|---|---|---|
| JP | S59137797 | A | 8/1984 |
| JP | S59142397 | A | 8/1984 |

* cited by examiner

METHOD FOR CONTROLLING A COUPLED HEAT EXCHANGER SYSTEM AND HEAT EXCHANGER SYSTEM

The invention relates to a method for controlling a coupled heat exchanger system.

EP 1150082 A1 discloses a heat exchanger system in which a first fluid stream, which is formed by atmospheric air, is cooled down in a heat exchanger system in counter-current to a second fluid stream (nitrogen) and a third fluid stream (oxygen). The heat exchanger system has a number of parallel heat exchanger blocks.

DE 4204172 A1 also discloses such a method in FIG. 5. Here, it is attempted with the control to keep the intermediate temperatures in the various blocks as equal as possible by setting a small secondary flow.

In the case of heat exchanger systems with a very great temperature sensitivity and small temperature differences, very small changes in the mass flows can lead to very different temperature profiles within the heat exchangers. Deviations from the temperature profiles calculated during the design may lead to inefficiencies of the heat exchange, but also to increased mechanical loading and consequently to a reduced service life of the heat exchanger blocks.

A "mass-flow adjusting device" is understood here as meaning any device that influences the mass flow of a fluid in a specifically intended manner. A mass-flow adjusting device may be formed for example as a hand valve, a control valve, a flap or a fixed orifice plate.

The invention is based on the object of operating a heat exchanger system of the type mentioned at the beginning in such a way that the heat exchange is carried out particularly efficiently and a particularly long service life of the heat exchanger blocks is achieved.

This object is achieved by the control achieving a reduction in the loading of the heat exchanger caused by load changes by keeping the fluctuations of the intermediate temperature as small as possible. Therefore, the dividing of the first fluid stream among the blocks is carried out in such a way that the intermediate temperature comes as close as possible to its setpoint value.

It has been found within the scope of the invention that, by measuring the intermediate temperature, it is possible in particular for variable temperature profiles to be determined very specifically and influenced quickly. These changed temperature profiles inside the heat exchangers cannot be detected sufficiently accurately by observing the inlet and outlet temperatures. The temperature profiles inside the heat exchanger change before the change becomes apparent from the outlet temperatures. A control that is based on measuring the inlet and outlet temperatures consequently can only react very late to deviations of the temperature profiles.

Within the scope of the invention, an intermediate temperature may of course also be measured at both heat exchanger blocks; furthermore, the heat exchanger system of the invention may also have more than two, for example three or four or even more, heat exchanger blocks.

Any known method may be used for measuring the intermediate temperature of a heat exchanger block, for example a measurement of the temperature on an outer surface of the heat exchanger block (DE 102007021564 A1), a measurement of the fluid temperature at an intermediate take-off, a measuring arrangement according to DE 202013008316 U1, or a measurement with an optical waveguide in accordance with DE 102007021564 A1.

Preferably, the first fluid stream is formed by a main flow, by the at least 50 mol % of the total amount of fluid that flows through the second heat exchanger block in the direction of the first fluid stream. The main flow comprises for example 80 to 100 mol %, in particular 85 to 95 mol %, of the total amount of fluid.

It is important that not just a small secondary flow is influenced by the control, but a main flow. Otherwise, it would not be possible to influence the heat exchanger profile to a sufficiently great extent to achieve a noticeable extension of the service life of the heat exchanger block.

In one specific embodiment of the invention, a first mass-flow adjusting device is arranged in the line of the first partial stream upstream or downstream of the heat exchanger system and a second mass-flow adjusting device is arranged in the line of the second partial stream upstream or downstream of the heat exchanger system; one of these two mass-flow adjusting devices is formed as a control valve and is set in dependence on the current value of the intermediate temperature. The other mass-flow adjusting device may take various forms of construction, such as for example a hand valve, a control valve, a flap or a fixed orifice plate. Therefore, precisely two mass-flow adjusting devices are necessary for setting the first fluid stream, one in the first partial stream and one in the second partial stream, at least one of these being formed as a control valve. The mass-flow adjusting devices may be arranged upstream or downstream of the corresponding heat exchanger block. To safeguard the heat exchanger blocks, the fittings should be of such a design as to close tightly during downtimes.

In a first variant of the invention, the first fluid stream is cooled down in the heat exchanger system, and the second and third fluid streams are warmed up in the heat exchanger system.

In a second variant, conversely, the first fluid stream is warmed up in the heat exchanger system, and the second and third fluid streams are cooled down in the heat exchanger system.

The first and second variants may also be combined, by providing that—on the basis of the first variant—the second and third fluid streams are formed by partial streams of a fourth fluid stream; furthermore, a second intermediate temperature is measured at the one of the two heat exchanger blocks at which the first intermediate temperature is not measured; the measurement of the second intermediate temperature is carried out between the warm end and the cold end. In dependence on the current value of this second intermediate temperature, it is set which part of the fourth fluid stream goes into the second fluid stream and which part goes into the third fluid stream.

Here, the invention is as it were applied twice, to be specific both to a divided stream to be cooled down (the first fluid stream) and to a divided stream to be warmed up (fourth fluid stream).

Figure 2:
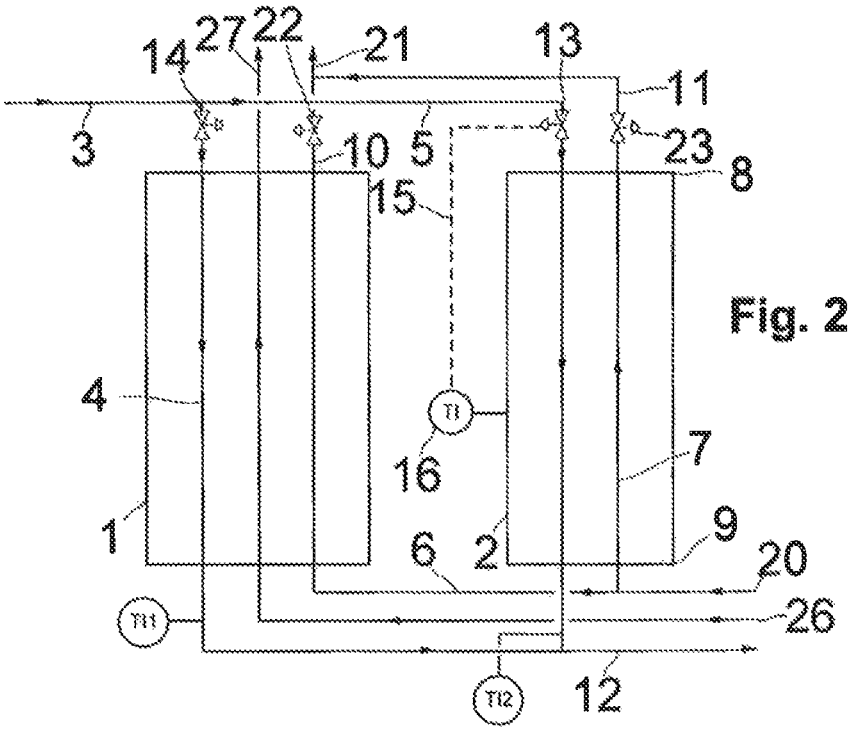
Figure 3:
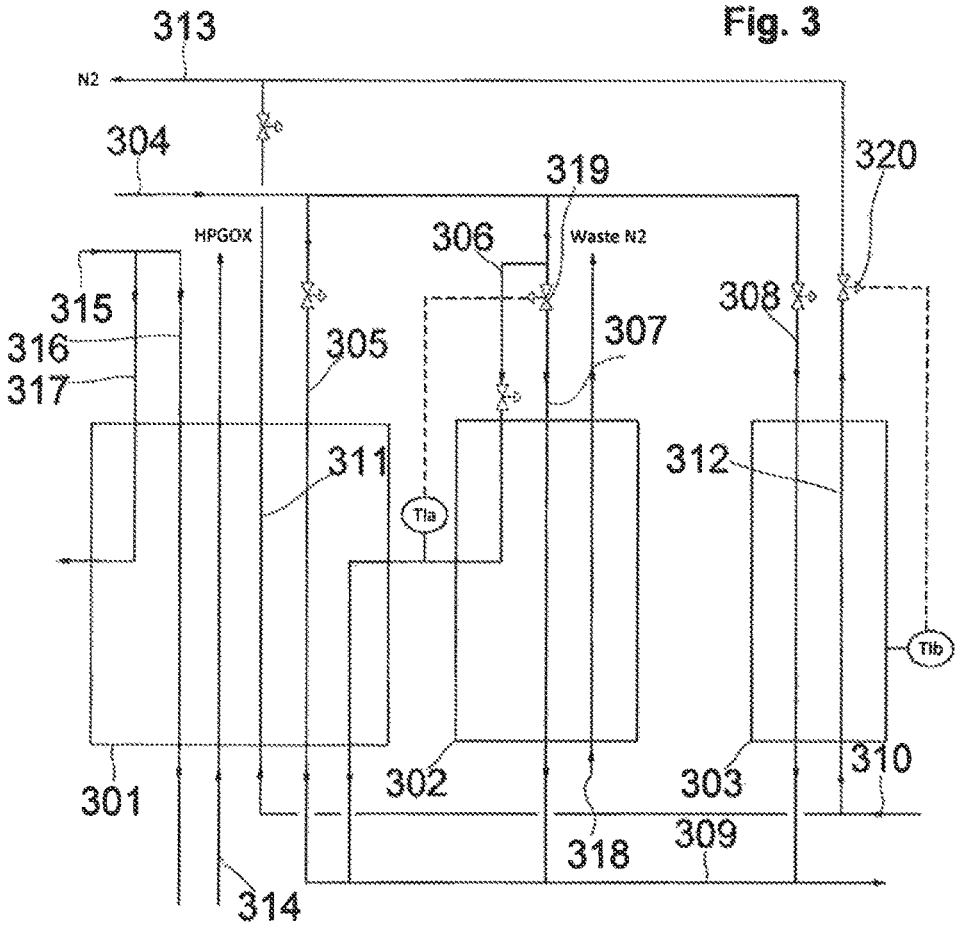

The invention and further details of the invention are explained in more detail below on the basis of exemplary embodiments that are schematically represented in the drawings, in which:

FIG. 1 shows a first exemplary embodiment of the invention with two heat exchanger blocks, FIG. 2 shows a second exemplary embodiment of the invention with two heat exchanger blocks and FIG. 3 shows a third exemplary embodiment with three heat exchanger blocks.

The drawings mainly show the measuring and adjusting devices that are necessary for the explanation and functioning of the invention. Further measuring and adjusting devices have generally been omitted for the sake of overall clarity. A person skilled in the art knows at which point additional devices such as valves can be arranged if need be.

The heat exchanger system from FIG. 1 consists of a first heat exchanger block 1 and a second heat exchanger block 2. A "first fluid stream" 3 is divided into a "first partial stream" 4 and a "second partial stream" 5 and cooled down in the two blocks 1, 2 of the heat exchanger system. In countercurrent thereto, a second fluid stream 6 and a third fluid stream 7 are warmed up, the second fluid stream 6 in the first heat exchanger block 1, the third fluid stream 7 in the second heat exchanger block 2.

At the warm end 8 of the heat exchanger blocks, the warmed-up second fluid stream 10 and the warmed-up third fluid stream 11 are drawn off. At the cold end 9 of the heat exchanger blocks, the cooled-down partial streams are united and drawn off as a cooled-down first fluid stream 12.

The drawing only shows the two valves 13 and 14 in the first fluid stream. Further valves that are not shown here may be required for the operation of the heat exchanger system.

The valve 14 is formed as a valve with a fixed correcting variable and is preset. The valve 14 is ideally 100% open, but must be closed manually, or by means of a corresponding control function, in order to increase the pressure loss by way of heat exchanger block 1 if the distribution of the pressure losses is so unfavorable that the temperature profile can no longer be controlled by way of the valve 13 alone. The valve 13 is formed as a control valve; according to the invention, its setting is performed in dependence on a temperature measurement TI (TI=Temperature Indication) at an intermediate point 16 of the second heat exchanger block 2 between its warm and cold ends 8, 9. The signal line contains a controller (not shown), which transmits to the control valve 13 the value to be set for the throughflow in the second partial stream 5. The controller may be formed by an analog electronic circuit or a digital device (for example a signal processor, a programmable controller, a microprocessor) or alternatively be realized in the process control system.

The aim of the control is to achieve a temperature profile over the height of the heat exchanger blocks that is as optimum as possible. The target value of the temperature TI is fixed by a theoretically determined temperature profile and the precise location of the temperature measurement. This target value may be fixed. Alternatively, the target value is prescribed variably over time, for instance with changing process conditions such as for example varying inlet temperatures of the flows. It may be meaningful also to measure the temperatures at the warm and/or cold end of the heat exchanger block or blocks and include them in the control.

In a specific application from low-temperature air separation, the first fluid stream is formed by air, the second fluid stream is formed by nitrogen and the third fluid stream is formed by oxygen.

The invention can equally be realized if the drawing is tilted vertically, and consequently the first fluid stream is the stream to be cooled down.

FIG. 2 corresponds largely to FIG. 1. Here, however, a stream to be warmed up is also divided among the two heat exchanger blocks 1, 2. A fourth fluid stream 20 is branched into the second fluid stream 6 and the third fluid stream 7. The warmed-up second fluid stream 10 and the warmed-up third fluid stream 11 are subsequently reunited to form a warmed-up fourth fluid stream 21.

In addition to the second fluid stream 6, a fifth fluid stream 26/27 flows through the first heat exchanger block 1.

For controlling the heat exchanger system 1, 2, three temperatures are measured:

TI1: temperature at the cold end of the first heat exchanger block 1, measurement in the cooled-down first partial stream 4

TI2: temperature at the cold end of the second heat exchanger block 2, measurement in the cooled-down second partial stream 5

TI: intermediate temperature, measurement at an intermediate point 16 of the second heat exchanger block 2 on the surface of the heat exchanger block.

The second and third fluid streams are operated as follows in the exemplary embodiment. The valve 22 is designed as a hand valve and is preset. The valve 23 is formed as a control valve; its setting is performed in dependence on the temperature difference TI1−TI2; the aim of the control is to keep this difference at zero, that is to say to bring the temperatures of the cold end of the two heat exchanger blocks to the same level.

The control of the first fluid stream is performed as in the example of FIG. 1 in dependence on the intermediate temperature TI. A control valve in the main flow to be cooled down of the second heat exchanger block 8 is acted upon by way of line 15.

In a specific application from low-temperature air separation, the first fluid stream is formed by air, the fourth fluid stream is formed by nitrogen and the fifth fluid stream is formed by oxygen.

In FIG. 3, the control method according to the invention is as it were applied twice, to be specific in a heat exchanger system with three heat exchanger blocks 301, 302, 303.

An air stream 304 is passed through the heat exchanger system in four partial streams 305, 306, 307, 308, and reunited in line 309. A gaseous nitrogen product stream 310 is conducted in two partial streams 311 and 312 through the left-hand heat exchanger block 301 and through the right-hand heat exchanger block 303, respectively, thereby warmed up to approximately ambient temperature and reunited in line 313.

An impure nitrogen stream 318 (waste N2) also flows through the heat exchanger block 302.

In the first heat exchanger block 301, liquid pressurized oxygen 314 is first evaporated (or pseudo-evaporated if its pressure is supercritical) and then warmed up to approximately ambient temperature. In countercurrent thereto, a partial stream 316 of a high-pressure air stream 315 is liquefied or pseudo-liquefied. Another partial stream 317 of the high-pressure air 315 is cooled down in the heat exchanger block only to an intermediate temperature and then fed to an expansion turbine that is not shown.

The partial stream 306 of the air stream 304 serves as an equalizing stream between heat exchanger blocks 301 and 302. It is removed from the block 302 at an intermediate temperature and introduced into the block 301 at a point of the latter corresponding to this intermediate temperature.

In the case of a first application of the invention in this exemplary embodiment, the "first partial stream" is formed by the stream 305 and the "second partial stream" is formed by the stream 307. The distribution of these two air streams among the two heat exchanger blocks 301 and 302 is performed in dependence on an intermediate temperature TIa of the heat exchanger block 302. This intermediate temperature TIa is measured in the stream 306, once it has left the heat exchanger block 302 and before it enters the heat exchanger block 301. The temperature measurement TIa thereby influences the opening of the valve 319, and consequently the flow rate of the main flow 307 to be cooled down.

In a second application of the invention, an intermediate temperature TIb on the surface of the heat exchanger block 303 is measured. The "first partial stream" is in this case formed by the nitrogen stream 311, the "second partial stream" is formed by the nitrogen stream 312. The opening of the valve 320, which determines the flow rate of the main flow 312 to be warmed up, is in this case set in dependence on the temperature TIb.

The invention claimed is:

1. A method for controlling a coupled heat exchanger system having at least a first heat exchanger block and a second heat exchanger block, wherein each of said first and second heat exchanger blocks has a warm end and a cold end, said method comprising:

dividing a first fluid stream, upstream of the heat exchanger system, into a first partial stream and a second partial stream, conducting the first partial stream through the first heat exchanger block and conducting the second partial stream through the second heat exchanger block, conducting a second fluid stream, in countercurrent to the first partial stream, through the first heat exchanger block, conducting a third fluid stream, in countercurrent to the second partial stream, through the second heat exchanger block, measuring a first intermediate temperature at the second heat exchanger block, between the warm end and the cold end of said second heat exchanger block, and wherein the part of the first fluid stream that forms said first partial stream and the part of the first fluid stream that forms said second partial stream are determined on the basis of the measured first intermediate temperature, said method further comprising:

controlling the operation of the heat exchanger blocks by reducing the loading of the heat exchanger blocks caused by load changes by reducing the size of fluctuations of the first intermediate temperature, wherein in addition to said second partial stream, another fluid stream flows through the second heat exchanger block in the direction of the second partial stream, and at least 50 mol % of the total amount of fluid that flows through the second heat exchanger block in the direction of the second partial stream is formed from said first fluid stream.

2. The method as claimed in claim 1, wherein a first mass-flow adjusting device is arranged in the line of the first partial stream upstream or downstream of the heat exchanger system, a second mass-flow adjusting device is arranged in the line of the second partial stream upstream or downstream of the heat exchanger system and one of these two mass-flow adjusting devices is formed as a control valve and the set value of the control valve is dependent on the current measured value of the first intermediate temperature.

3. The method as claimed in claim 1, wherein the first and second partial streams of the first fluid stream are cooled down in the heat exchanger system and the second and third fluid streams are warmed up in the heat exchanger system.

4. The method as claimed in claim 1, wherein the first and second partial streams of the first fluid stream are warmed up in the heat exchanger system and the second and third fluid streams are cooled down in the heat exchanger system.

5. The method as claimed in claim 3, wherein the second and third fluid streams are formed by partial streams of a fourth fluid stream, a second intermediate temperature is measured at a heat exchanger block in which the first intermediate temperature is not measured, between the warm end and the cold end thereof, and wherein the part of the fourth fluid stream that forms said second fluid stream and the part of the fourth fluid stream that forms said third fluid stream are determined on the basis of the measured value of the second intermediate temperature.

6. The method as claimed in claim 5, wherein a first mass-flow adjusting device is arranged in the line of the first partial stream upstream or downstream of the heat exchanger system, a second mass-flow adjusting device is arranged in the line of the second partial stream upstream or downstream of the heat exchanger system and one of these two mass-flow adjusting devices is formed as a control valve and the set value of the control valve is dependent on the current measured value of the first intermediate temperature.

7. The method as claimed in claim 2, wherein said control valve is arranged in the line of the second partial stream upstream or downstream of the second heat exchanger block.

8. The method as claimed in claim 6, wherein said control valve is arranged in the line of the second partial stream upstream or downstream of the second heat exchanger block.

9. The method as claimed in claim 5, wherein, in addition to the second fluid stream, a fifth fluid stream flows through the first heat exchanger block in countercurrent to the first partial stream.

10. The method as claimed in claim 8, wherein, in addition to the second fluid stream, a fifth fluid stream flows through the first heat exchanger block in countercurrent to the first partial stream.

11. The method as claimed in claim 2, wherein the temperature of the first partial stream is measured at the cold end of the first heat exchanger block, and the temperature of the second partial stream is measured at the cold end of the second heat exchanger block, and wherein a third mass-flow adjusting device formed as a second control valve is arranged in the line of the third fluid stream downstream of the second heat exchanger block, and the set value of the second control valve is dependent on the difference of the measured values of the temperature of the first partial stream and the temperature of the second partial stream.

12. The method as claimed in claim 3, wherein the temperature of the first partial stream is measured at the cold end of the first heat exchanger block, and the temperature of the second partial stream is measured at the cold end of the second heat exchanger block, and wherein a third mass-flow adjusting device formed as a second control valve is arranged in the line of the third fluid stream downstream of the second heat exchanger block, and the set value of the second control valve is dependent on the difference of the measured values of the temperature of the first partial stream and the temperature of the second partial stream.

13. The method as claimed in claim 4, wherein the temperature of the first partial stream is measured at the cold end of the first heat exchanger block, and the temperature of the second partial stream is measured at the cold end of the second heat exchanger block, and wherein a third mass-flow adjusting device formed as a second control valve is arranged in the line of the third fluid stream downstream of the second heat exchanger block, and the set value of the second control valve is dependent on the difference of the measured values of the temperature of the first partial stream and the temperature of the second partial stream.

14. The method as claimed in claim 1, wherein said heat exchanger system has, in addition to said first heat exchanger block and said second heat exchanger block, a third heat exchange block having a cold end and a warm end, and said method further comprises dividing the first fluid stream, upstream of the heat exchanger system, into said first partial stream, said second partial stream, a third partial stream, and a fourth partial stream, introducing said third partial stream into said second heat exchanger block, said third partial stream being said another fluid stream that flows through the second heat exchanger block in the direction of the second partial stream, conducting the fourth partial stream through the third heat exchanger block, conducting a fourth fluid stream, in countercurrent to the fourth partial stream, through the third heat exchanger block, removing said third partial stream from said second heat exchange block at a point intermediate point between the warm end and the cold end of said second heat exchanger, and introducing said third partial stream into said first heat exchange block at an intermediate point between the warm end and the cold end of said first heat exchanger block, and measuring said first intermediate temperature by measuring the temperature of said third partial stream after said third partial stream is removed from said second heat exchange block and before said third partial stream is introduced into said first heat exchange block.

15. A method for controlling a coupled heat exchanger system having at least a first heat exchanger block and a second heat exchanger block, wherein each of said first and second heat exchanger blocks has a warm end and a cold end, said method comprising:

dividing a first fluid stream, upstream of the heat exchanger system, into a first partial stream, a second partial stream, a third partial stream, and a fourth partial stream, conducting the first partial stream through the first heat exchanger block and conducting the second partial stream through the second heat exchanger block, conducting a second fluid stream, in countercurrent to the first partial stream, through the first heat exchanger block, conducting a third fluid stream, in countercurrent to the second partial stream, through the second heat exchanger block, measuring a first intermediate temperature at the second heat exchanger block, between the warm end and the cold end of said second heat exchanger block, and wherein the part of the first fluid stream that forms said first partial stream and the part of the first fluid stream that forms said second partial stream are determined on the basis of the measured first intermediate temperature, said method further comprising:

controlling the operation of the heat exchanger blocks by reducing the loading of the heat exchanger blocks caused by load changes by reducing the size of fluctuations of the first intermediate temperature, introducing said third partial stream into said second heat exchanger block, conducting the fourth partial stream through the third heat exchanger block, conducting a fourth fluid stream, in countercurrent to the fourth partial stream, through the third heat exchanger block, removing said third partial stream from said second heat exchange block at a point intermediate point between the warm end and the cold end of said second heat exchanger, and introducing said third partial stream into said first heat exchange block at an intermediate point between the warm end and the cold end of said first heat exchanger block, and measuring said first intermediate temperature by measuring the temperature of said third partial stream after said third partial stream is removed from said second heat exchange block and before said third partial stream is introduced into said first heat exchange block.

* * * * *